US009299300B2

(12) United States Patent
Oh et al.

(10) Patent No.: US 9,299,300 B2
(45) Date of Patent: Mar. 29, 2016

(54) LIQUID CRYSTAL DISPLAY DEVICE AND DRIVING METHOD THEREOF

(71) Applicant: LG Display Co., Ltd., Seoul (KR)

(72) Inventors: Dae Seok Oh, Paju-si (KR); Bo Gun Seo, Paju-si (KR); Seung Hwan Shin, Suncheon-si (KR)

(73) Assignee: LG DISPLAY CO., LTD., Seoul (KR)

( * ) Notice: Subject to any disclaimer, the term of this patent is extended or adjusted under 35 U.S.C. 154(b) by 89 days.

(21) Appl. No.: 14/134,712

(22) Filed: Dec. 19, 2013

(65) Prior Publication Data

US 2014/0176526 A1 Jun. 26, 2014

(30) Foreign Application Priority Data

Dec. 24, 2012 (KR) ..... 10-2012-0151660

(51) Int. Cl.
*G09G 3/36* (2006.01)

(52) U.S. Cl.
CPC ..... *G09G 3/3611* (2013.01); *G09G 3/3685* (2013.01); *G09G 3/3696* (2013.01); *G09G 2330/021* (2013.01); *G09G 2360/16* (2013.01)

(58) Field of Classification Search
CPC . G09G 3/3611; G09G 3/3685; G09G 3/3696; G09G 2360/16; G09G 2330/021
See application file for complete search history.

(56) References Cited

U.S. PATENT DOCUMENTS

| | | | | |
|---|---|---|---|---|
| 6,249,270 | B1 | 6/2001 | Ito | |
| 2007/0091049 | A1 * | 4/2007 | Cho | G09G 3/2011 345/98 |
| 2013/0033527 | A1 * | 2/2013 | Yen | 345/690 |

FOREIGN PATENT DOCUMENTS

| | | | |
|---|---|---|---|
| CN | 1953005 | A | 4/2007 |
| JP | 2000231088 | A | 8/2000 |
| KR | 1020070079643 | A | 8/2007 |

* cited by examiner

*Primary Examiner* — Dwayne Bost
*Assistant Examiner* — Christopher Kohlman
(74) *Attorney, Agent, or Firm* — Dentons US LLP

(57) ABSTRACT

Disclosed are an LCD device and a driving method thereof. The LCD device includes at least one source driving ICs configured to drive a plurality of data lines formed in a panel, a timing controller configured to generate a power control signal used to change a level of a driving voltage applied to the source driving ICs according to a pattern of an image output to the panel, and a driving voltage generator configured to generate a first driving voltage or a second driving voltage according to the power control signal to drive the source driving ICs. The first and second driving voltages have different levels.

8 Claims, 8 Drawing Sheets

LIQUID CRYSTAL DISPLAY DEVICE AND DRIVING METHOD THEREOF

CROSS-REFERENCE TO RELATED APPLICATIONS

This application claims the benefit of the Korean Patent Application No. 10-2012-0151660 filed on Dec. 24, 2012, which is hereby incorporated by reference for all purposes as if fully set forth herein.

BACKGROUND

1. Field of the Invention

The present invention relates to a liquid crystal display (LCD) device. More particularly, the present invention relates to an LCD device and a driving method thereof that reduce power consumption.

2. Discussion of the Related Art

Flat panel display (FPD) devices are applied to various electronic devices such as portable phones, tablet personal computers (PCs), notebook computers, etc. The FPD devices include liquid crystal display (LCD) devices, plasma display panels (PDPs), organic light-emitting display devices, etc. Recently, electrophoretic display (EPD) devices are widely used as the FPD devices.

In the FPD devices, the LCD devices can be applied to all electronic devices ranging from small devices to large devices. Thus, LCDs are being widely used. A liquid crystal injected into an LCD device is driven according to a voltage difference between a data voltage supplied to a pixel electrode and a common voltage supplied to a common electrode to change a light transmittance, thereby enabling an image to be displayed.

FIG. 1 is an exemplary diagram illustrating a consumption power use state in a general LCD device.

Power used in the general LCD device, as illustrated in FIG. 1, is generated by a power supply 50, which generates the power by using input power (Rogic Power) input from an external system.

As illustrated in FIG. 1, 38% of the total power generated by the power supply 50 is used by a timing controller and the other integrated circuits (ICs), about 3% of the total power is used by a gate driving IC, and the other 59% power is used by a source driving IC (Source D-IC), a gamma block, and a common voltage block (Vcom block).

Here, the timing controller and the other ICs are referred to as a digital part, and the source driving IC, the gamma block, the common voltage block, the gate driving IC are referred to as an analog part.

As seen in FIG. 1, in a related art LCD device, the source driving IC consumes far more power than the other elements. Therefore, when power consumed by the source driving IC is reduced, the whole power consumption of the related art LCD device is reduced.

The reason that power consumption of the source diving IC is high is because a driving voltage VDD having a constant level is applied to the source driving IC.

For example, the source driving IC receives the driving voltage VDD to generate a gamma reference voltage suitable for an output image, and generates a data voltage by using the gamma reference voltage to output the data voltage to a data line. The driving voltage VDD of the related art always maintains a constant value.

Therefore, even though the driving voltage VDD is not fully used, since the driving voltage VDD always maintains a constant value, power is unnecessarily consumed in terms of whole power consumption of the related art LCD device.

To provide an additional description, in the related art LCD device, the driving voltage VDD which is applied to the source driving IC for generating the gamma reference voltage always maintains a constant level. That is, even when only the gamma reference voltage having a low level is used by an analog-to-digital converter (DAC Block) of the source driving IC, the driving voltage VDD having an undesired high level is continuously applied to the DAC. For this reason, power is wasted.

FIG. 2 are diagrams describing a method of generating a driving voltage in the power supply applied to the related art LCD device.

A driving voltage generator of the related art power supply for generating the driving voltage VDD is generally configured with a DC-DC converter. The DC-DC converter is configured as illustrated in FIG. 2(*a*).

A transistor T of the power supply controls charging and discharging of an inductor to generate the driving voltage VDD.

In a normal state, charging energy of the inductor is the same as discharging energy of the inductor. That is, an inductor current IL in a turn-on section of the transistor is the same as an inductor current IL in a turn-off section of the transistor.

In the normal state, when in a continuous mode, referring to FIG. 2B, "Vin*D+(Vin−Vout)*(1−D)=0" is calculated by substituting "IL_Ton+IL_Toff=0", "Vin*Ton/L+(Vin−Vout)*Toff/L=0", "Vin*Ton+(Vin−Vout)*Toff=0", "Ton=DT", and "Toff=(1−D)T". As a result, Vout/Vin=1/1−D is obtained.

In an abnormal state, referring to FIG. 2(*c*), when charging energy of inductor>discharging energy of inductor, the driving voltage VDD (Vout) increase, and when charging energy of inductor<discharging energy of inductor, the driving voltage VDD (Vout) is dropped.

That is, the charging energy of the inductor is varied with the turn-on time and turn-off time of the transistor, causing a change in the driving voltage.

In the power supply 50, in order to control charging and discharging of the inductor, a frequency of a transistor switching signal (FET Switching Signal) input to the transistor T may be determined by a resistor R connected to the transistor T. FIG. 3 is a graph showing a relationship between the resistor R and the frequency of the transistor switching signal input to the transistor T. As seen in FIG. 3, the higher the resistance of the resistor R, the lower the frequency of the transistor switching signal.

In the related art LCD device, the frequency of the transistor switching signal is fixed irrespective of kinds of images. Therefore, the same frequency is used in a normal pattern, in which an output current (consumption power) is low like white, or a special pattern in which the output current is very high, for example, in a Z-inversion system using a 1By1 pattern. For this reason, an efficiency of the driving voltage generator (VDD Boost Logic) is reduced in the normal pattern, causing an adverse effect to power consumption.

In the related art LCD device, as shown in FIG. 4, a frequency of the driving voltage generator is set according to a characteristic of the special pattern such that a normal image is output even in the special pattern in which the output current is very high, power is wasted in the normal pattern in which the output current is low, causing a reduction in an efficiency of the driving voltage generator.

For example, in FIG. 4, when a panel outputs the special pattern in which the output current is very high, the driving voltage generator outputs a current of about 0.2 A or more, in which case it can be seen that the efficiency of the driving voltage generator is about 90%. Even when the current of 0.2 A or more flows, the efficiency of the driving voltage generator is about 90%.

However, the related art LCD device does not output only the special pattern, and outputs even the normal pattern which is normally output with a low current. When the normal pattern is output, as shown in FIG. 4, it can be seen that the efficiency of the driving voltage generator is rapidly reduced.

In the related art LCD device, a level of the driving voltage VDD is set to a constant level so as to effectively respond to the special pattern. To this end, the frequency of the transistor switching signal input to the transistor T for controlling the level of the driving voltage is fixed. The frequency of the transistor switching signal is fixed because the transistor T is connected to the resistor R having a fixed resistance. As described above, since the driving voltage generator outputs only the driving voltage VDD having a constant level, power is unnecessarily wasted even in the normal pattern requiring low power, causing a reduction in the efficiency of the driving voltage generator.

SUMMARY OF THE INVENTION

Accordingly, the present invention is directed to provide an LCD device and a driving method thereof that substantially obviate one or more problems due to limitations and disadvantages of the related art.

An aspect of the present invention is directed to provide an LCD device and a driving method thereof, which change a level of a driving voltage applied to a source driving IC according to a pattern of an image output to a panel.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an LCD device including: at least one or more source driving ICs configured to drive a plurality of data lines formed in a panel; a timing controller configured to generate a power control signal, used to change a level of a driving voltage applied to the source driving ICs, according to a pattern of an image output to the panel; and a driving voltage generator configured to generate a first driving voltage or a second driving voltage according to the power control signal to drive the source driving ICs, the first and second driving voltages having different levels.

In another aspect of the present invention, there is provided a method of driving an LCD device including: analyzing input video data to generate different power control signals according to a pattern of an image output to a panel; generating a first driving voltage or a second driving voltage according to the power control signals, the first and second driving voltages having different levels; and converting image data corresponding to the input video data into data voltages according to the first driving voltage or the second driving voltage to output the image data to the panel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE ILLUSTRATED EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 5:
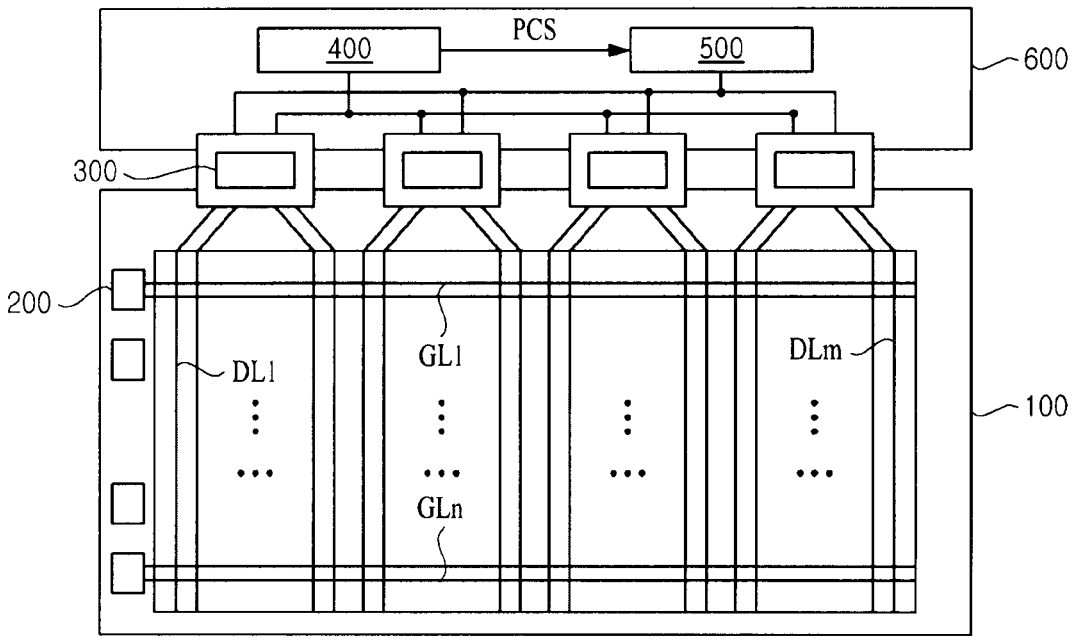
FIG. 5 is an exemplary diagram illustrating a configuration of an LCD device according to an embodiment of the present invention.
Figure 6:
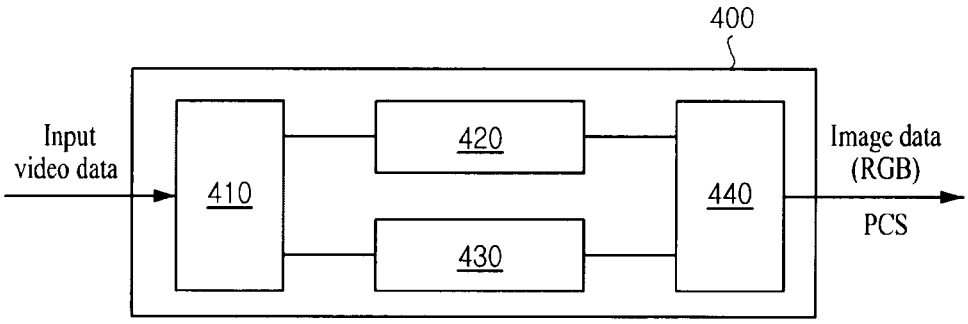
FIG. 6 is an exemplary diagram illustrating a configuration of a timing controller in an LCD device according to an embodiment of the present invention.
Figure 7:
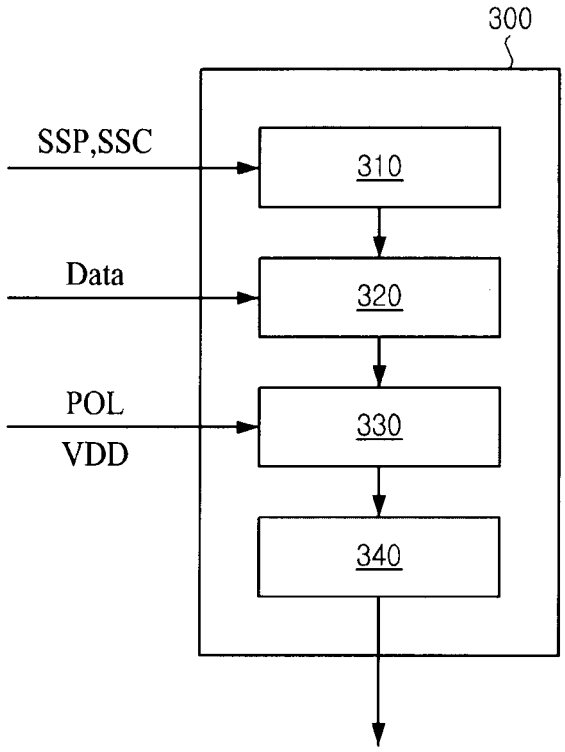
FIG. 7 is an exemplary diagram illustrating a configuration of a source driving IC in an LCD device according to an embodiment of the present invention.
Figure 8:
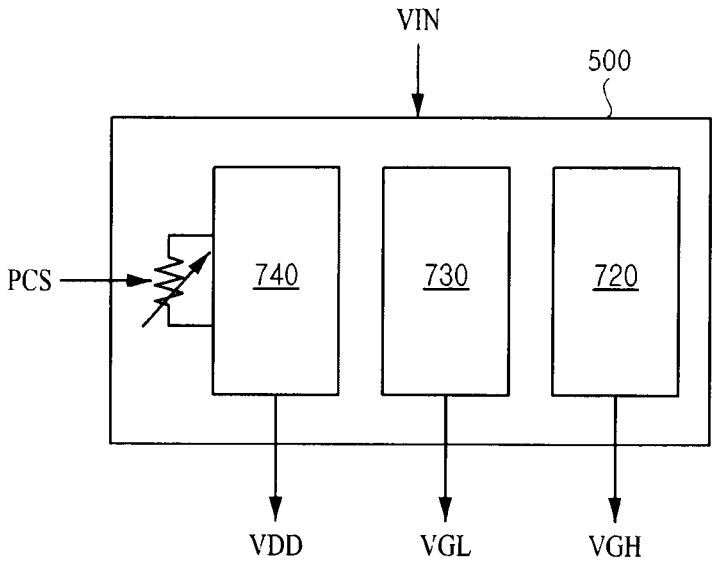
FIG. 8 is an exemplary diagram illustrating a configuration of a power supply in an LCD device according to an embodiment of the present invention.

FIG. 5 is an exemplary diagram illustrating a configuration of an LCD device according to an embodiment of the present invention, FIG. 6 is an exemplary diagram illustrating a configuration of a timing controller in an LCD device according to an embodiment of the present invention, FIG. 7 is an exemplary diagram illustrating a configuration of a source driving IC in an LCD device according to an embodiment of the present invention, and FIG. 8 is an exemplary diagram illustrating a configuration of a power supply in an LCD device according to an embodiment of the present invention.

As illustrated in FIG. 5, the LCD device according to an embodiment of the present invention includes: a panel 100 in which a plurality of gate lines GL1 to GLn and a plurality of data lines DL1 to DLm are formed to intersect each other; at least one or more gate driving ICs 200 that drive the plurality of gate lines GL1 to GLn of the panel 100; at least one or more source driving ICs 300 that drive the plurality of data lines DL1 to DLm of the panel 100; a timing controller 400 that controls the gate driving ICs and the source driving ICs; and a power supply (a power IC) 500 that supplies power, input from an external system, to elements of the LCD device. Here, the timing controller 400 and the power supply 500 may be provided on a main board 600.

In the panel 100, a plurality of pixels are respectively formed in a plurality of pixel areas defined by intersections between the gate lines and the data lines. A thin film transistor (TFT) and a pixel electrode (PXL) are formed in each of the plurality of pixels.

The TFT supplies a data voltage, transferred through a corresponding data line, to the pixel electrode in response to a scan signal transferred through a corresponding gate line.

The pixel electrode drives a liquid crystal disposed between the pixel electrode and a common electrode in response to the data voltage, thereby adjusting a transmittance of light.

The panel 100 applied to the present invention may be applied to all liquid crystal modes in addition to a twisted nematic (TN) mode, a vertical alignment (VA) mode, an in-plane switching (IPS) mode, and a fringe field switching (FFS) mode. Also, the LCD device according to the present invention may be implemented as a transmissive LCD device, a semi-transmissive LCD device, a reflective LCD device, or the like.

The timing controller 400 generates a gate control signal GCS used to control an operation timing of each of the gate driving ICs 200 and a data control signal DCS used to control an operation timing of each of the source driving ICs 300 by using a timing signal (i.e., a vertical sync signal Vsync, a horizontal sync signal Hsync, and a data enable signal DE) input from the external system, and supplies video data RGB to the source driving ICs 300.

A plurality of the gate control signals GCS generated by the timing controller 400 may be changed according to a type of the gate driving IC 200. For example, when the gate driving IC 200 is connected to the panel 100 in a chip-on film (COF) type or a tape carrier package (TCP) type, the gate control signals generated by the timing controller 400 include a gate start pulse GSP, a gate shift clock GSC, and a gate output enable signal GOE. Also, as illustrated in FIG. 5, when the gate driving IC 200 is mounted on the panel 100 in a gate-in panel (GIP) type, the gate control signals generated by the timing controller 400 include a gate start signal VST and a gate clock GCLK.

The data control signals generated by the timing controller 400 includes a source start pulse SSP, a source shift clock signal SSC, a source output enable signal SOE, and a polarity control signal POL. However, the data control signals may be variously changed according to whether an interface type between the timing controller 400 and the source driving IC 300 is a transistor-transistor logic (TTL) type, a mini low voltage differential signaling (LVDS) type, or an embedded clock point to point interface (EPI) type.

The timing controller 400 analyzes video data input from the external system to determine whether an image to be output to the panel 100 has a specific pattern or a normal pattern.

The timing controller 400 transfers a power control signal PCS, used to select a driving voltage VDD to be supplied to the source driving IC 300, to the power supply (the power IC) 500 according to the determined pattern. Herewith, the timing controller 400 realigns the input video data so as to match a size of the panel 100 and the number of the source driving ICs 300, and transfers the realigned image data to the source driving ICs 300.

To this end, as illustrated in FIG. 6, the timing controller 400 includes a determiner 410, a control signal generator 420, a data aligner 430, and an output unit 440.

First, the determiner 410 receives the input video data and the timing signal from the external system.

Moreover, the determiner 410 analyzes the video data input from the external system to determine whether an image to be output to the panel 100 has the specific pattern or the normal pattern. Subsequently, the determiner 410 generates the power control signal PCS used to control the power supply 500 according to the determined result, and transfers the power control signal PCS to the power supply 500.

The power control signal PCS includes a first power control signal PCS1 used to generate a driving voltage to be applied to the specific pattern and a second power control signal PCS2 used to generate a driving voltage to be applied to the normal pattern.

In detail, the determiner 410 analyzes the input video data in units of a predetermined frame. When it is determined that the input video data form the specific pattern, the determiner 410 generates the first power control signal PCS1 that allows the power supply 500 to output a first driving voltage VDD1 corresponding to the specific pattern, and transfers the first driving voltage VDD1 to the power supply 500. When it is determined that the input video data form the normal pattern, the determiner 410 generates the second power control signal PCS2 that allows the power supply 500 to output a second driving voltage VDD2 corresponding to the normal pattern, and transfers the second driving voltage VDD2 to the power supply 500.

Here, the specific pattern denotes a pattern in which an output current is very high and which requires a high voltage and a high amount of current. For example, the specific pattern may be a shutdown pattern, in which a white pixel and a black pixel are alternated in units of one pixel, or a smear pattern in which the white pixel and the black pixel are alternated in units of two pixels.

The above-described specific pattern is not applied all types of LCD devices. That is, the specific pattern may be various set according to an inversion system applied to the LCD device and a type of each pixel.

Therefore, a storage unit (not shown) storing information about the specific pattern is included in or provided outside the timing controller 400.

The determiner 410 may determine whether the input video data form the specific pattern or the normal pattern, by using the information about the specific pattern which is stored in the storage unit.

A method, in which the determiner 410 determines the specific pattern, may be variously set according to the specific pattern and the inversion system. In detail, the method of determining the specific pattern may be variously implemented according to whether the LCD device according to the present invention is driven in a normally black mode or a normally white mode or according to an inversion system applied to the LCD device. An embodiment in which the determiner 410 determines the specific pattern will be described in detail with reference to FIGS. 9 and 10.

Second, the data aligner 430 realigns the input video data so as to match the panel 100 and the inversion system, and outputs the realigned image data.

Third, the control signal generator 420 generates the control signal, and generates the first power control signal PCS1 or the second power control signal PCS2 according to the determined result.

Fourth, the output unit 440 transfers the gate control signal generated by the control signal generator 420 to the gate driving IC 200, transfers the data control signal generated by the control signal generator 420 to the source driving IC 300, transfers the image data generated by the data aligner 430 to the source driving IC 300, and transfers the power control signal PCS1 or PCS2 generated by the control signal generator 420 to the power supply 500.

Each of the gate driving ICs 200 sequentially supplies the scan signal to the plurality of gate lines GL1 to GLn by using the gate control signals GCS generated by the timing controller 400.

The source driving IC 300 converts the image data, transferred from the timing controller 400, into analog data voltages, and respectively supplies image data signals (corresponding the analog data voltages) for one horizontal line (one gate line) to the data lines at every one horizontal period in which the scan signal is supplied to one gate line.

That is, the source driving IC 300 converts digital image data, transferred from the timing controller 400, into analog data voltages by using gamma reference voltages generated from the driving voltage VDD by the power supply 500.

Moreover, when the gate driving IC 200 sequentially supplies the scan signal to the gate lines according to the gate control signal GCS transferred from the timing controller 400, the source driving IC 300 respectively outputs the data voltages to the data lines during one horizontal period.

To this end, as illustrated in FIG. 7, the source driving IC 300 includes a shift register 310, a latch 320, a digital-to-analog converter (DAC) 330, and an output buffer 340.

Here, the elements of the source driving IC 300 are fundamentally driven with the driving voltage VDD transferred from the power supply 500. In particular, the DAC 330 generates a gamma reference voltage by using the driving voltage VDD transferred from the power supply 500, and converts digital image data into analog data voltages by using the gamma reference voltage.

First, the shift register 310 sequentially shifts the source start pulse SSP transferred from the timing controller 400 according to the source shift clock signal SSC to output a sampling signal.

Second, the latch 320 latches red (R), green (G), and blue (B) image data RGB in response to the sampling signal to simultaneously output the latched image data RGB Third, the DAC 330 converts the digital image data, transferred from the latch 320, into positive and negative digital image data signals by using the driving voltage VDD1 supplied from the power supply 500 and the polarity control signal POL transferred from the timing controller 400, and outputs the positive and negative digital image data signals.

In this case, the maximum level of the gamma reference voltage may be varied according to the driving voltage VDD supplied from the power supply 500. The maximum amount of power consumption of the source driving IC 300 may be varied by varying the maximum level of the gamma reference voltage.

Fourth, the output buffer 340 amplifies data voltages transferred from the DAC 330, and respectively supplies the amplified data voltages to the data lines. The output buffer 340 may use the driving voltage VDD supplied from the power supply 500.

In this case, an amount of current corresponding to a data voltage output to each data line may be varied with the driving voltage. An amount of power consumption of the source driving IC 300 may be varied by varying the amount of current.

The power supply 500 generates power necessary for the elements of the LCD device by using the power input from the external system.

To this end, as illustrated in FIG. 8, the power supply 500 includes: a driving voltage generator 740 that generates the driving voltage VDD by using an input voltage VIN input from the external system and the power control signal PCS transferred from the timing controller 400, and transfers the driving voltage VDD to the source driving IC 300; a gate high voltage generator 720 that outputs a gate high voltage VGH to be supplied to the gate driving IC 200; and a gate low voltage generator 730 that outputs a gate low voltage VGL to be supplied to the gate driving IC 200. In addition to such elements, various elements for generating a voltage having various levels necessary for the LCD device may be further included in the power supply 400.

Figure 1:
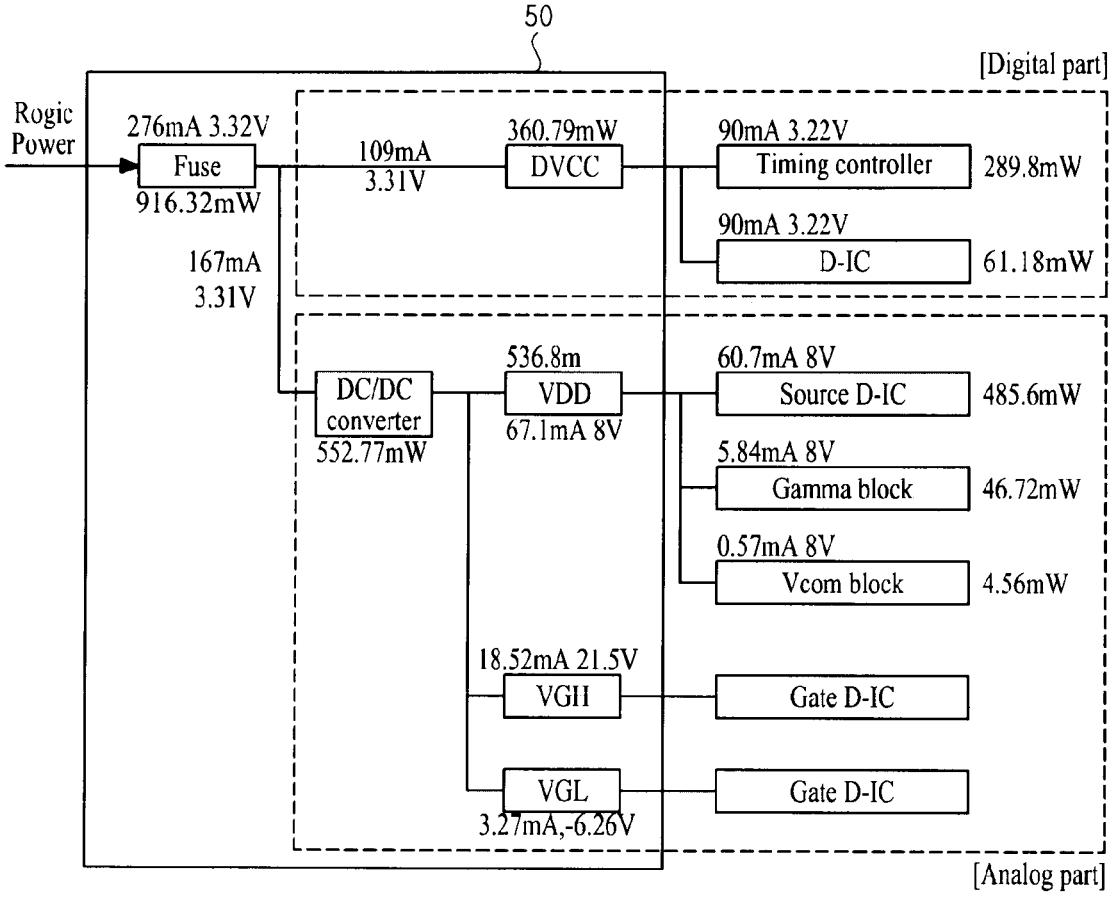
FIG. 1 Related Art
FIG. 1 is an exemplary diagram illustrating a consumption power use state in a general LCD device.
Figure 2:
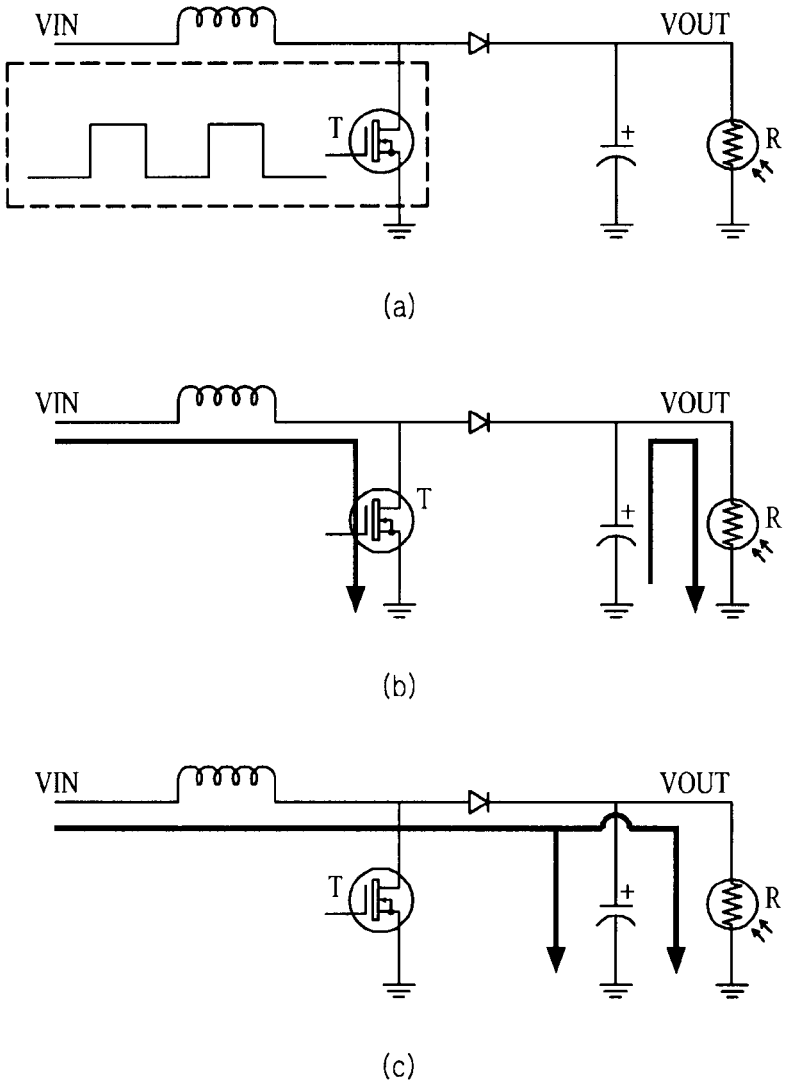
FIG. 2 Related Art
FIG. 2 are exemplary diagrams describing a method of generating a driving voltage in a power supply applied to a related art LCD device.
Figure 3:
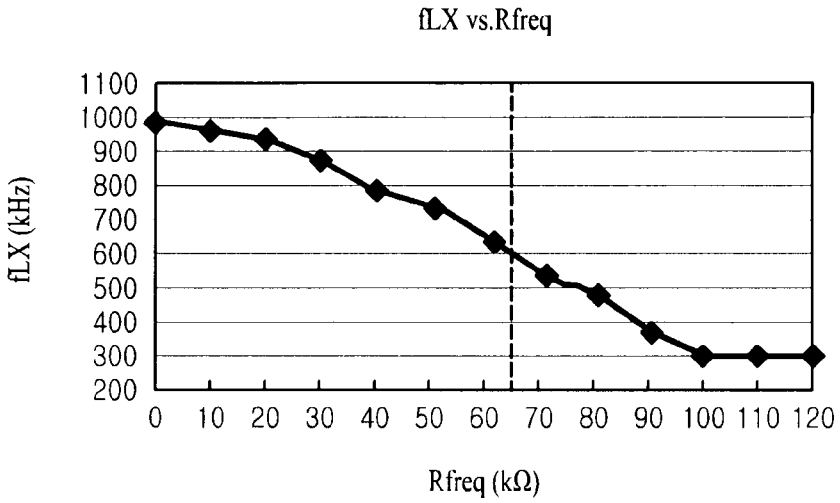
FIG. 3 Related Art
FIG. 3 is a graph showing a relationship between a resistor and a frequency of a transistor switching signal.
Figure 4:
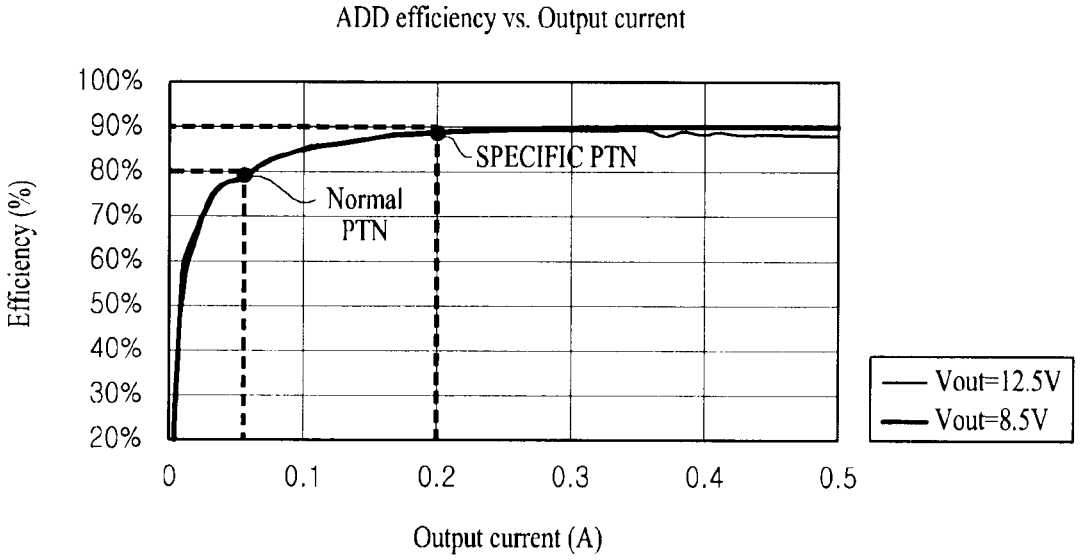
FIG. 4 Related Art
FIG. 4 is a graph showing a relationship between an output current and an efficiency of a driving voltage generator.

In particular, as illustrated in FIG. 8, the driving voltage generator 740 includes a variable resistor CR. The variable resistor CR corresponds to the resistor R described above with reference to FIG. 2, and particularly, a resistance value of the variable resistor CR may be varied by the power control signal PCS.

That is, when the resistance value of the variable resistor CR is varied according to the power control signal PCS, a driving frequency of a transistor switching signal generated in the driving voltage generator 740 is varied. Therefore, charging energy of an inductor included in the driving voltage generator 740 is varied, and a level of the driving voltage VDD output from the driving voltage generator 740 may be finally varied by varying the charging energy of the inductor.

For example, when the first power control signal PCS1 is input as the power control signal PCS, a first driving frequency is generated by the variable resistor CR, and the first driving voltage VDD1 is generated by the first driving frequency. The first driving voltage VDD1 is transferred to the source driving IC 300, and is used to output the specific pattern.

Moreover, when the second power control signal PCS2 is input as the power control signal PCS, a second driving frequency is generated by the variable resistor CR, and the second driving voltage VDD2 is generated by the second driving frequency. The second driving voltage VDD2 is transferred to the source driving IC 300, and is used to output the normal pattern.

The first driving voltage VDD1 or the second driving voltage VDD2, as described above, may be used in the DAC 330 or output buffer 340 of the source driving IC 300.

Here, the first driving voltage VDD1 is a voltage that is used to cause the maximum efficiency of the driving voltage generator 740 when the specific pattern is output, and the second driving voltage VDD2 is a voltage that is used to cause the maximum efficiency of the driving voltage generator 740 when the normal pattern is output.

In the LCD device, the level of the driving voltage VDD may be varied to correspond to the specific pattern or the normal pattern. Therefore, the driving voltage generator 740 may be driven at the maximum efficiency when the specific pattern is output and when the normal pattern is output.

Hereinafter, a method of driving an LCD device according to an embodiment of the present invention will be described in detail with reference to FIGS. 5 to 10.

Figure 9:
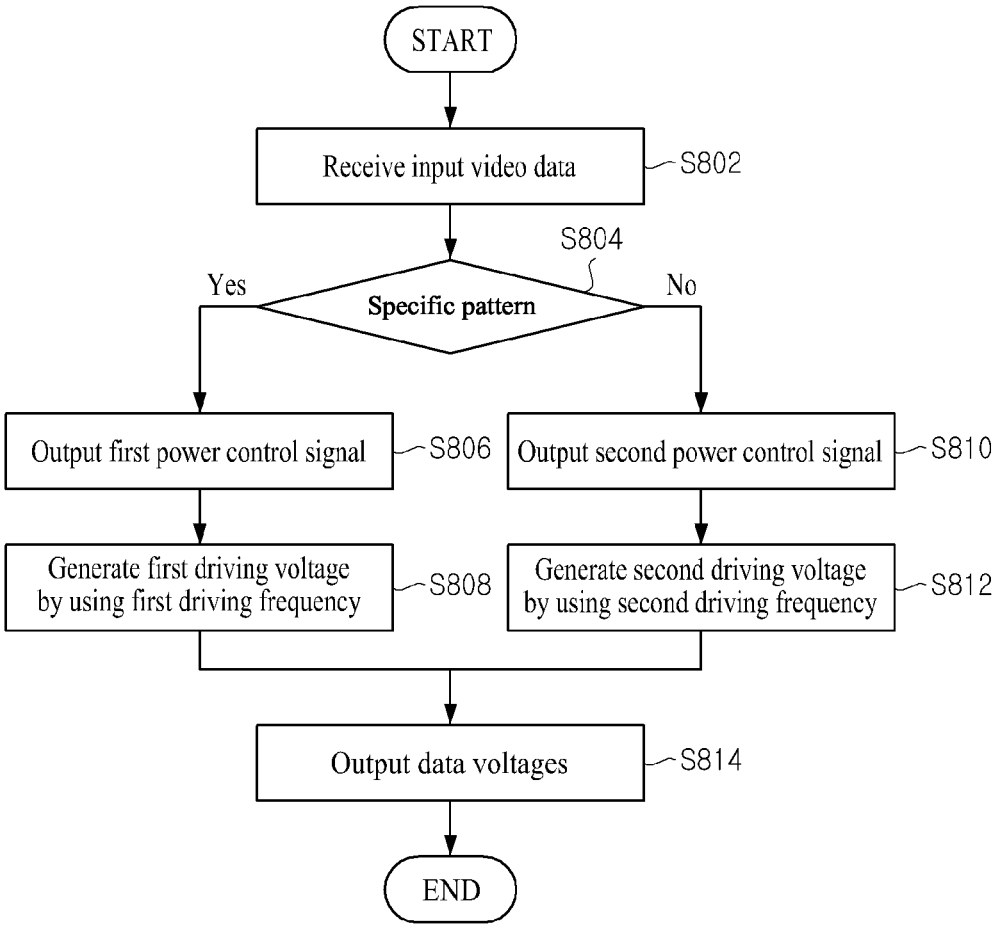
FIG. 9 is a flowchart describing a method of driving an LCD device according to an embodiment of the present invention.
Figure 10:
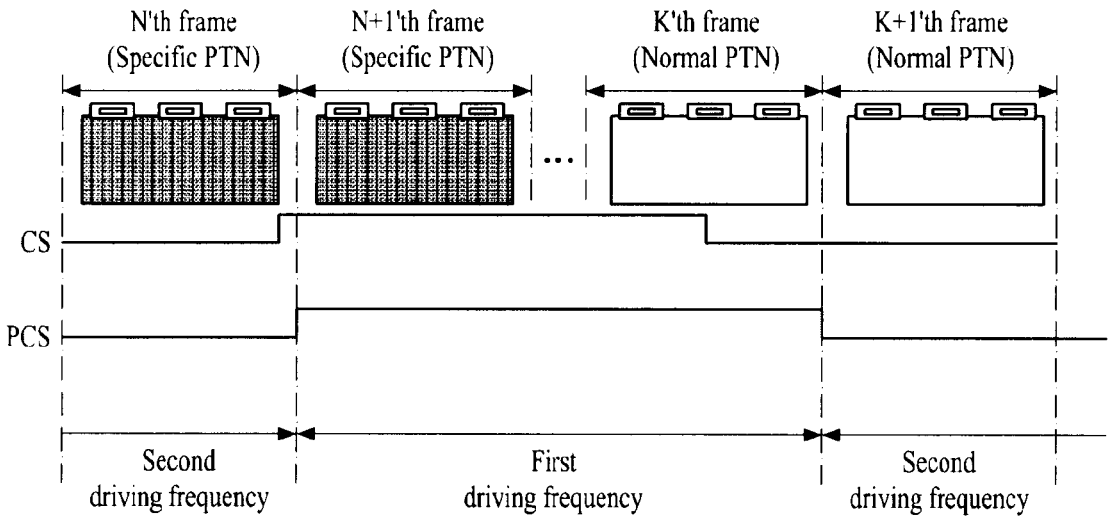
FIG. 10 is an exemplary diagram describing a method of determining a normal pattern and a specific pattern in an LCD device according to an embodiment of the present invention.

FIG. 9 is a flowchart for describing a method of driving an LCD device according to an embodiment of the present invention. FIG. 10 is an exemplary diagram for describing a method of determining a normal pattern and a specific pattern in an LCD device according to an embodiment of the present invention.

Hereinafter, as shown in FIG. 10, as an example, the method of driving the LCD device will be described in a case where the specific pattern is a lengthwise stripe type (hereinafter simply referred to as a shutdown pattern) in which the white pixel and the black pixel are alternated in units of one pixel, and where the normal pattern (a mosaic pattern) is output until before an nth frame, the shutdown pattern vulnerable to the Z-inversion system is output from the nth frame, and the normal pattern is again output from a kth frame.

When input video data are received from the external system in operation S802, the timing controller 400 determines whether the input video data form the specific pattern or the normal pattern in operation S804.

To this end, the determiner 410 of the timing controller 400 determines whether data applied through one data line differs from data applied through a next data line among the input video data composing a frame at a start stage of each frame, and counts the number of different data.

For example, when the counting operation is performed for the nth frame in FIG. 10, the number of counted data exceeds a predetermined number because the nth frame forms the shutdown pattern.

That is, in the shutdown pattern, since vertically adjacent pixels include the same input video data, the number of counted data exceeds the predetermined number.

In this case, the determiner 410 changes a count signal CS (corresponding to the number of counted data) to 1 or an on state, and thus, the control signal generator 420 generates the first power control signal PCS1 in operation S806.

The variable resistor CR included in the driving voltage generator 740 of the power supply 500 is varied by the first power control signal PCS1, and thus, the driving voltage generator 740 generates the first driving frequency. The level of the first driving frequency may be variously set according to a structure of the driving voltage generator 740.

The driving voltage generator 740 generates the first driving voltage VDD1 by using the first driving frequency in operation S808.

In operation S814, the first driving voltage VDD1 is transferred to the source driving IC 300 to drive the source driving IC 300, which outputs data voltages by using the first driving voltage VDD1.

That is, when the specific pattern is output, the first driving voltage VDD1 is a voltage for driving the source driving IC 300, and the driving voltage generator 740 drives the source driving IC 300 at the maximum efficiency.

In FIG. 10, the first power control signal PCS1 and the first driving frequency are illustrated as being output from an n+1st frame, but an output timing thereof may be variously set by the timing controller 400.

That is, when the nth frame is determined as the specific pattern, the timing controller 400 may control the output timing so that data voltages of the nth frame are respectively output to the plurality of data lines with the first driving voltage VDD1.

In this case, when image data corresponding to the input video data are received, the source driving IC 300 converts the image data into data voltages by using the driving voltage which is generated by the driving voltage generator according to a pattern of the input video data, and respectively outputs the image data to the data lines.

In performing the operation for the kth frame, since the kth frame is not the shutdown pattern but is the normal pattern, the number of counted data does not exceed the predetermined number.

That is, in the normal pattern, since input video data of vertically adjacent pixels are not necessarily the same, the number of counted data does not exceed the predetermined number.

In this case, the determiner 410 changes the count signal CS to 1 or an off state, and thus, the control signal generator 420 generates the second power control signal PCS2 in operation S810.

The variable resistor CR included in the driving voltage generator 740 of the power supply 500 is varied by the second power control signal PCS2, and thus, the driving voltage generator 740 generates the second driving frequency.

The driving voltage generator 740 generates the second driving voltage VDD2 by using the second driving frequency in operation 5812.

In operation S814, the second driving voltage VDD2 is transferred to the source driving IC 300 to drive the source driving IC 300, which outputs data voltages by using the second driving voltage VDD2. The second driving voltage VDD2 is lower than the first driving voltage VDD1.

That is, when the normal pattern is output, the second driving voltage VDD2 is a voltage for driving the source driving IC 300, and the driving voltage generator 740 drives the source driving IC 300 at the maximum efficiency.

The present invention optimizes the efficiency of the driving voltage generator 740. In detail, the present invention varies a level of a voltage output from the driving voltage generator 740 for each pattern output to the panel 100, thus optimizing the efficiency of the driving voltage generator 740. Accordingly, power consumption of the LCD device according to the present invention can be reduced.

In more detail, in a related art driving voltage generator, the frequency of the transistor switching signal is set in order for the efficiency of the driving voltage generator to be optimized based on the specific pattern requiring the maximum voltage. Therefore, in a related art LCD device, the efficiency of the driving voltage generator is optimized by a frequency and a duty in the specific pattern having a high output current. However, in the normal pattern having a low output current, despite an external output current not being required, the driving voltage generator excessively outputs a current, causing a reduction in the efficiency of the driving voltage generator.

However, the driving voltage generator 740 applied to the present invention outputs the driving voltage by using the optimized frequency according to whether a pattern output to the panel 100 is the specific pattern or the normal pattern, and thus, the efficiency of the driving voltage generator can be optimized.

To this end, the timing controller 400 analyzes the input video data to determine the specific pattern and the normal pattern.

According to the present invention, the level of the driving voltage applied to the source driving IC is changed according to a pattern of an image output to the panel, thus reducing power consumption of the LCD device.

That is, according to the present invention, the level of the driving voltage applied to the source driving IC is lowered when the normal pattern driven with low power is output, thus reducing the power consumption of the LCD device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display (LCD) device comprising:

source driving ICs configured to drive a plurality of data lines formed in a panel;

a timing controller configured to generate a power control signal, used to change a level of a driving voltage applied to the source driving ICs, according to a pattern of an image output to the panel; and a driving voltage generator configured to generate a first driving voltage or a second driving voltage according to the power control signal to drive the source driving ICs, the first and second driving voltages having different levels, wherein the driving voltage generator varies a resistance value according to the power control signal, and generates a first driving frequency of a transistor switching signal in the driving voltage generator used to generate the first driving voltage or a second driving frequency used to generate the second driving voltage.

2. The LCD device of claim 1, wherein the timing controller analyzes input video data using pre-stored information about a specific pattern to determine whether the input video data forms the specific pattern having a high power consumption or a normal pattern having a low power consumption, and generates different power control signals.

3. The LCD device of claim 2, wherein, when the input video data forms the specific pattern, the timing controller generates a first power control signal to transfer the first power control signal to the driving voltage generator, and the driving voltage generator generates the first driving voltage according to the first power control signal, and when the input video data forms the normal pattern, the timing controller generates a second power control signal to transfer the second power control signal to the driving voltage generator, and the driving voltage generator generates the second driving voltage according to the second power control signal.

4. The LCD device of claim 1, wherein when image data corresponding to the input video data are received, each of the source driving ICs converts the image data into data voltages by using the driving voltage generated by the driving voltage generator according to a pattern of the input video data, and respectively outputs the data voltages to the plurality of data lines.

5. A method of driving a liquid crystal display (LCD) device, the method comprising:

analyzing input video data to generate different power control signals according to a pattern of an image output to a panel;

generating a first driving voltage or a second driving voltage according to the power control signals, the first and second driving voltages having different levels; and converting image data corresponding to the input video data into data voltages according to the first driving voltage or the second driving voltage to output the image data to the panel, wherein the generating of the first driving voltage or the second driving voltage comprises:

varying a resistance value according to the power control signal; and generating a first driving frequency of a transistor switching signal in the driving voltage generator used to generate the first driving voltage or a second driving frequency used to generate the second driving voltage.

6. The method of claim 5, wherein the generating of different power control signals comprises analyzing the input video data using pre-stored information about a specific pattern to determine whether the input video data forms the specific pattern having a high power consumption or a normal pattern having a low power consumption, and generating the different power control signals.

7. The method of claim 6, wherein, the generating of the different power control signals comprises:

when the input video data forms the specific pattern as the analyzed result, generating a first power control signal; and when the input video data forms the normal pattern as the analyzed result, generating a second power control signal, and the generating of a first driving voltage or a second driving voltage comprises:

generating the first driving voltage according to the first power control signal; and generating the second driving voltage having a level lower than the first driving voltage according to the second power control signal.

8. The method of claim 5, wherein the outputting of the image data comprises, when image data corresponding to the input video data are received, converting the image data into data voltages by using the driving voltage generated by the driving voltage generator according to a pattern of the input video data, and respectively outputting the data voltages to the plurality of data lines.

* * * * *